United States Patent [19]

Braun et al.

[11] Patent Number: 4,950,942

[45] Date of Patent: Aug. 21, 1990

[54] CEMENTLESS LAMP BULB AND BASE COMBINATION

[75] Inventors: Alfred Braun, Herbrechtingen; Peter Helbig, Sontheim/Benz; Hermann Steiner, Herbrechtingen, all of Fed. Rep. of Germany

[73] Assignee: Patent Treuhand Gesellschaft für elektrische Gluhlampen, Munich, Fed. Rep. of Germany

[21] Appl. No.: 300,485

[22] Filed: Jan. 23, 1989

[30] Foreign Application Priority Data

Mar. 3, 1988 [DE] Fed. Rep. of Germany ..... 3806978

[51] Int. Cl.[5] ..... H01J 5/50; H01J 5/60

[52] U.S. Cl. ..... 313/318; 313/51; 362/226

[58] Field of Search ..... 313/318, 113, 50, 51; 362/296, 297, 341, 346, 211, 226

[56] References Cited

U.S. PATENT DOCUMENTS

| | | | |
|---|---|---|---|
| 4,100,448 | 7/1978 | Chipner et al. | 313/51 X |
| 4,412,273 | 10/1983 | Helbig et al. | 362/211 |
| 4,641,056 | 2/1987 | Sanders et al. | 313/51 |
| 4,751,421 | 6/1988 | Braun et al. | 313/318 |
| 4,769,574 | 9/1988 | Nagasawa et al. | 313/318 |

*Primary Examiner*—Sandra L. O'Shea

*Attorney, Agent, or Firm*—Frishauf, Holtz, Goodman & Woodward

[57] ABSTRACT

To permit ready attachment of a pinch or press seal terminating a halogen incandescent lamp, particularly for automotive use, a base sleeve (9), for example of steel, is formed as a hollow cylinder having, at the end remote from the bulb, at least two spaced flange elements (28) extending radially inwardly of the sleeve and essentially at right angles to the axis of the lamp. A base plug element, formed as a solid body, for example of highly heat-resistant plastic material, is located projecting from the base sleeve, and positioned remote from the bulb. The essentially cylindrical solid body (29) is formed with a circumferential collar of smaller outside diameter, and separated from the remainder of the solid body by a circumferential ring groove. The collar (30) is subdivided into a plurality of circumferential projections (31, 32), at least two of said circumferential projections are formed with radially outwardly extending holding projections (33) which engage behind and around the flange elements of the base sleeve (9) upon relative rotation of the base sleeve and the plug element formed by the essentially cylindrical solid body (29). A metallic holder element (7) surrounds the pinch or press seal and has extending leg or apron portions which are metal-to-metal welded, for example spot-welded to the base sleeve (9).

21 Claims, 6 Drawing Sheets

CEMENTLESS LAMP BULB AND BASE COMBINATION

Reference to related patents, assigned to the assignee of the present application, the disclosure of which is hereby incorporated by reference:

U.S. Pat. No. 4,412,273, Helbig, a co-inventor;

U.S. Pat. No. 4,751,421, Braun, a co-inventor hereof.

Reference to related patent, the disclosure of which is hereby incorporated by reference:

U.S. Pat. No. 4,641,056, Sanders et al, (to which European Patent Application No. 85 201 643 corresponds).

FIELD OF THE INVENTION

The present invention relates to an electric lamp, and more particularly to attaching a lamp bulb to a lamp base without the use of cement, especially to small halogen incandescent lamps suitable for use in combination with a reflector, such as an automotive headlight lamp - reflector combination.

BACKGROUND

Automotive headlamps, which are given the standard designation H1 lamps, H3 lamps or H4 lamps, operate at extremely high temperatures. The filament of the lamp must be accurately positioned with respect to an engagement or holder ring which fits against a portion of the headlamp reflector so that a predetermined light distribution will result when the lamp-reflector combination is installed in an automotive vehicle. The bulbs of such lamps, thus, frequently are connected to a base without the use of a connecting cement. Typically, the lamps are single-ended glass bulbs which terminate in a pinch or press seal at one end, which may be defined as the press seal end, and a top end, usually having an exhaust tip through which the interior of the lamp bulb had been exhausted, and then a fill gas introduced into the bulb. Current supply leads extend outwardly of the press seal, and at least one incandescent filament is located interiorly of the bulb, electrically connected to the current supply leads. It has previously been proposed to use two-part base constructions, having an outer sleeve and a base plug element of insulating material. A holder element surrounds the pinch or press seal of the bulb and is coupled to the base sleeve to position the bulb with respect to the base sleeve which, also, may be used as a reference element to determine the position of the filament with respect to the reflector, and which may have a holding or adjustment ring formed thereon. The connecting terminals for the lamp extend, typically, through the base and are electrically connected to the current supply leads.

Lamps of this type, with a combination metal-insulating material, for example plastic material bases, are used frequently in connection with automotive headlights and one type of lamp is described in the referenced U.S. Pat. No. 4,412,273, Helbig, the disclosure of which is hereby incorporated by reference, assigned to the assignee of the present application. The Helbig U.S. Pat. No. 4,412,273 describes a lamp for use with a reflector which, however, uses a comparatively complex base. The base sleeve is retained in a receiving portion of a disk element. The optical quality of the headlamp depends on the quality of this attachment which should have as little play as possible.

U.S. Pat. No. 4,641,056, Sanders et al, proposes the construction of a base of synthetic material which is formed of two parts, connected by ultrasonic bonding or welding. One of the parts is a hollow cylinder, the second one forming the base or bottom wall thereof. The hollow cylindrical part surrounds a cylindrical base sleeve and is mechanically connected therewith by interengaging notches and projections. The terminal tabs or terminal spades are connected to the base wall portion by ultrasonic welding. U.S. Pat. No. 4,751,421, Braun, describes a holder element for the bulb. In this construction, a metal holder is coupled to a plastic base element.

THE INVENTION

It is an object to provide an electric lamp, and especially a halogen incandescent lamp suitable for combination with a reflector, for example for use as an automotive headlight, which is of simple construction, simple to assemble, while providing for reliable mechanical attachment of the bulb in the base, in accurate and predetermined alignment with respect thereto and providing for reliable electrical connections.

Briefly, the base is formed as a base sleeve in shape of a hollow sheet metal cylinder having at the end remote from the bulb at least two spaced internally projecting flange elements. The flange elements are coupled to a base plug element of insulating material, typically a plastic material, located within the base sleeve remote from the portion thereof which extends towards the bulb. The base plug element is an essentially cylindrical solid body, fitting into the sleeve, and formed with a cylindrical collar at the end facing the sleeve. The collar is undercut, and has a diameter which is reduced with respect to the diameter of the cylindrical solid body. The collar is subdivided into a plurality of circumferential portions, at least two of which are formed with radially outwardly holding projections which engage behind the flange elements of the base sleeve.

The arrangement has the advantage that substantially less material is necessary than for prior art constructions, and the energy required to secure the bulb to the base during manufacture is substantially reduced. Ultrasonic plastic welding connections are no longer needed, the assembly time is reduced and the steps simplified. Basically, the connection between insulating, typically synthetic or plastic components and the sheet metal sleeve is obtained by what might be termed a modified, interengaging bayonet connection.

The material for the base plug element is preferably a heat resistant plastic, which may be a thermoplastic or thermosetting compound. Such materials are preferred due to their ease of manufacture, working, and low weight.

The high quality of the mechanical connection between the base sleeve, the bottom of the base, and the lamp or bulb, which is highlighted, for example, in the referenced Sanders U.S. Pat. No. 4,641,056, is obtained, in accordance with the present invention, by the interaction between the plug element with the metal sleeve which, however, in contrast to the prior art, is greatly simplified by the rotary bayonet connection. The cylindrical base sleeve is formed with the aformentioned inwardly directed flange elements, in the form of inwardly bent-over edge portions of the base sleeve. The inward extension or width of these inwardly extending flange elements, preferably, are about 10% of the diameter of the base sleeve in order to obtain a suitable engagement surface for precise alignment of the lamp with the bottom of the base. If the width is made substantially larger, difficulties may arise to properly place the current supply leads.

The flange elements are formed by ring portions of the internally extending end of the sleeve, the ring portions being spaced from each other by a just slightly greater spacing than the circumferential length of the attachment projections of the bottom of the base. This permits, during assembly, to seat the base sleeve on a flat zone of the base plug in such a manner that the inwardly extending flange elements first extend into the spacing between subdivided portions of the collar. Preferably, four collar portions, formed with holding projections, and four inwardly directed flange elements are provided in order to obtain a sufficient number of attachment points with suitable engagement or abutting surface regions.

After preliminary assembly, the base sleeve is rotated with respect to the base plug, so that the holding projections engage the inwardly extending flange portions. The holding projections and the flange portions may be formed with interengaging snap connections, providing a reliable connection which cannot be released, without destruction of the entire lamp and base.

In accordance with a preferred feature of the invention, the thickness of the flanges is deliberately selected to be slightly greater than the spacing between the flat engagement zone of the base plug and the bottom side of the holding projections, so that, upon rotation, a frictional interference fit connection results. The inwardly extending flanges are clamped between the engagement surface on the plug element and the bottom of the holding projections. To assist this rotation, in accordance with another preferred feature of the invention, the holding projections are slightly inclined to provide a gradual engagement surface, and the clamping force increasing gradually. Upon relative rotation, one or all of the holding projections, or other rises in the engagement zone, may serve as a stop to define the extent of rotation. The height of the stops should be carefully selected so that, initially, the flange elements can be rotated over the stops while the stops as such will retain their function as stop elements, for example by engagement with a specific portion of the inwardly extending flange elements.

The stop regions have, in accordance with the present invention, a further task. Upon rotation, the possibility of lateral shift of the base sleeve with respect to the base plug must be excluded. One obvious solution would be to match the outer diameter of the ring-shaped collar precisely to the inner diameter of the circle defined by the flange elements. This, however, is not desired because engagement of the base sleeve to the base plug would be substantially more difficult because of the danger of not perfect alignment during assembly; further, rotation would be inhibited due to the high friction. Central seating of the base plug in the base sleeve is important for adjustment of the position of the lamp bulb.

In accordance with a feature of the invention, the stops, in the form of slight projections, are arranged to have the shape of ring sections or portions, the outer arc length forming an adjustment stop for the exact centered alignment of the base sleeve with respect to the plug element. The base sleeve is formed, between the internally extending flange projections, with an inwardly bent-over edge zone, the width of which is substantially less than that of the flange elements and having an inner diameter which is selected such that the respective end zone portions, after rotation, snugly engage the projections along the circular sections or portions and along the outer arcuate extent thereof.

The base plug, preferably, is an essentially cylindrical solid body, which is simple to manufacture. In relatively small headlamp units, for example of the H1 or H3 lamp types, which have only a single lamp filament, a cylindrical solid construction is of particular advantage. The larger mass of the plug element with respect to a plug having a hollow interior is hardly significant. On the other hand, however, a solid plug facilitates the formation of the collar, with an engagement surface which ensures a sufficiently wide surface area for the internally extending flange elements of the base sleeve. The previously practiced melting-in or ultrasonic welding of metal parts in thermoplastic materials, as described, for example, in the earlier Sanders U.S. Pat. No. 4,641,056, or the insertion of metallic portions into a press and subsequent deformation with thermosetting press parts, as described, for example, in the referenced U.S. Pat. No. 4,412,273, Helbig, and customary with larger lamps, for example of the H4 type, is no longer needed. Rather, the entire body portion of the plug element can be utilized in order to obtain a purely mechanical connection. This arrangement permits substantial reduction of manufacturing time and, simultaneously, solves problems of space which may arise, particularly in lamps of smaller dimension.

A particularly simple connection of this type can be obtained for the contact spades by forming longitudinal slits at the end remote from the bulb which extend axially through the plug element. The slits have a width which is matched to the width of the contact spades, to receive, for example, about one-third of the length of the contact spades. The contact spades themselves are formed with sawtooth-like projections at their narrow sides in the portion where they can be received in the slits so that the projections from the contact spades will engage in the slits and seat the contact spades securely therein.

A metal holder to hold the press seal of the bulb can be used which is somewhat similar to that of the prior U.S. Pat. No. 4,751,421, Braun. In contrast to the construction of the prior patent, however, where the metal holder is connected to a plastic base, the metal holder is welded to the metal base sleeve.

DRAWINGS

Figure 3A:
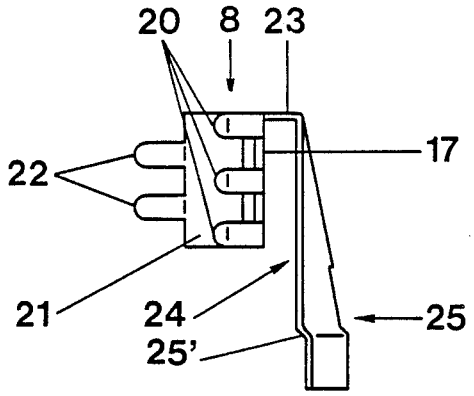
Figure 3B:
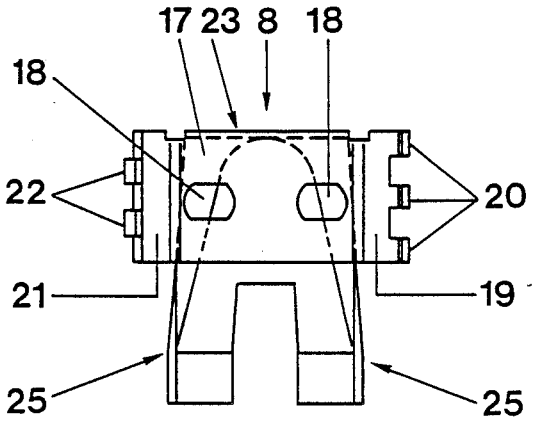

FIG. 3*a* is a side view of a holder element for the lamp;

FIG. 3*b* is a front view of the element of FIG. 3*a;*

Figure 1:
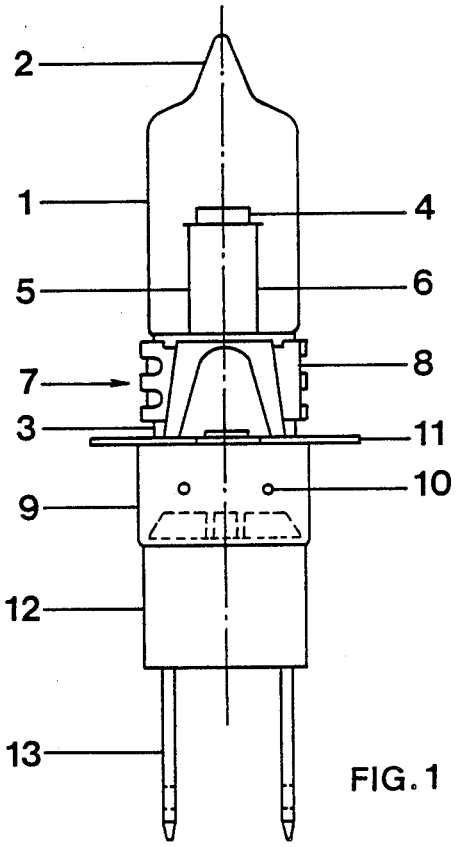
FIG. 1 is a schematic side view of the lamp - base combination, suitable for assembly with an automotive headlamp reflector.
Figure 4A:
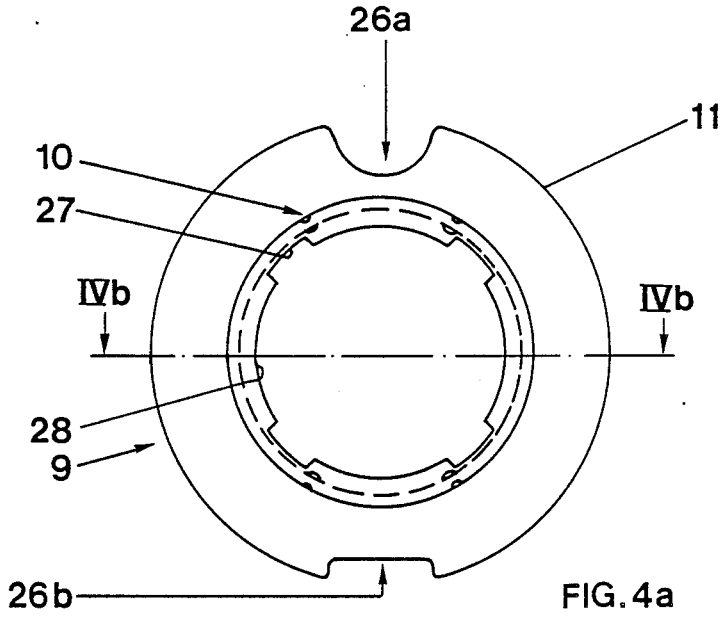
Figure 4B:
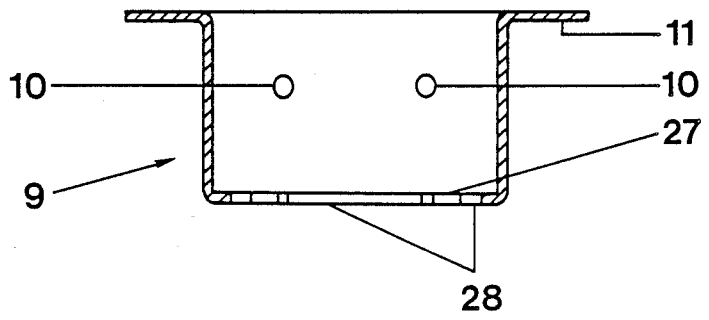

FIG. 4*a* is a bottom view of the base sleeve of the lamp of FIG. 1;

FIG. 4*b* is a diametric cross section along line IVb of FIG. 4*a;*

Figure 5A:
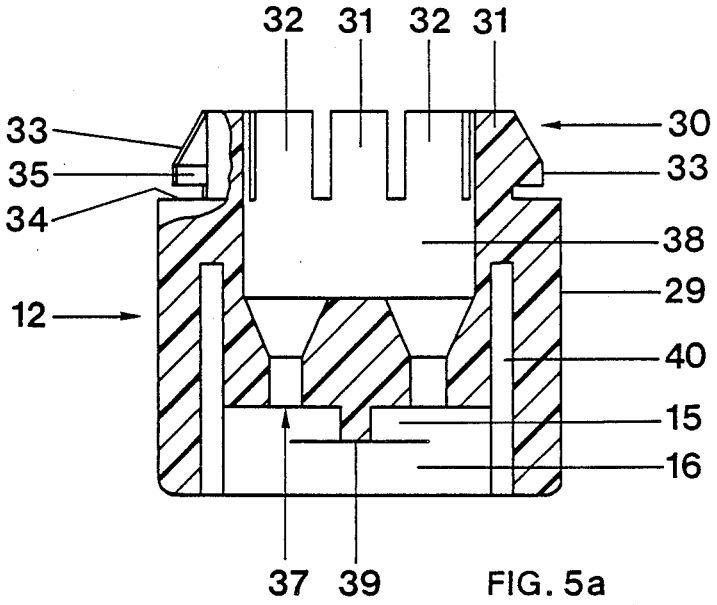
Figure 5C:
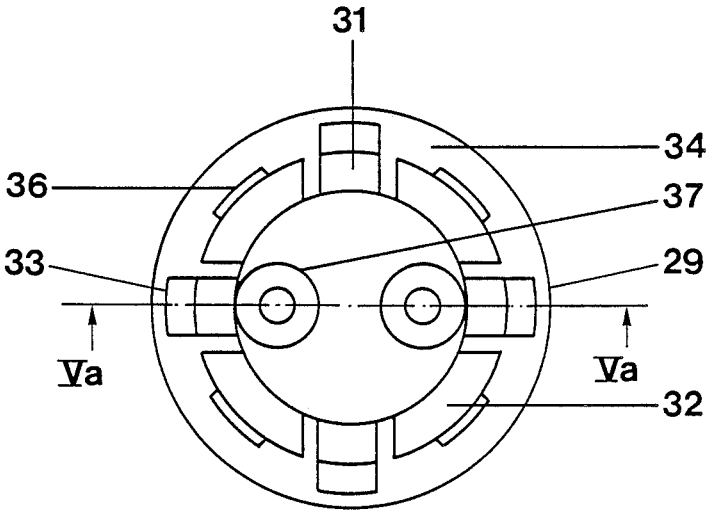
Figure 5B:
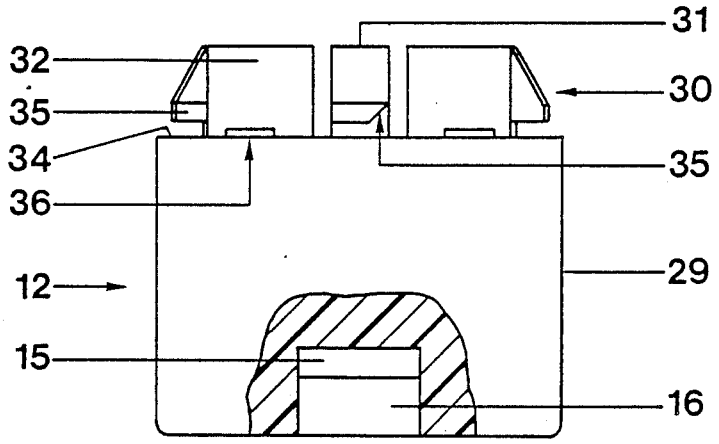
Figure 5D:
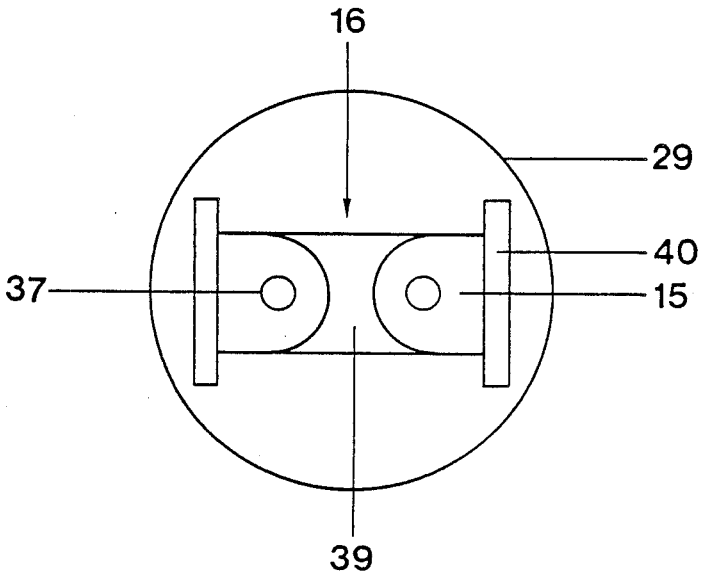
Figure 6B:
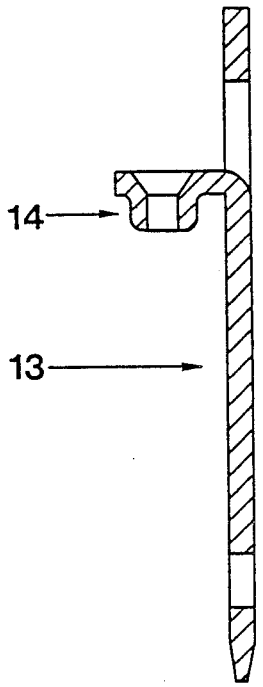
Figure 6A:
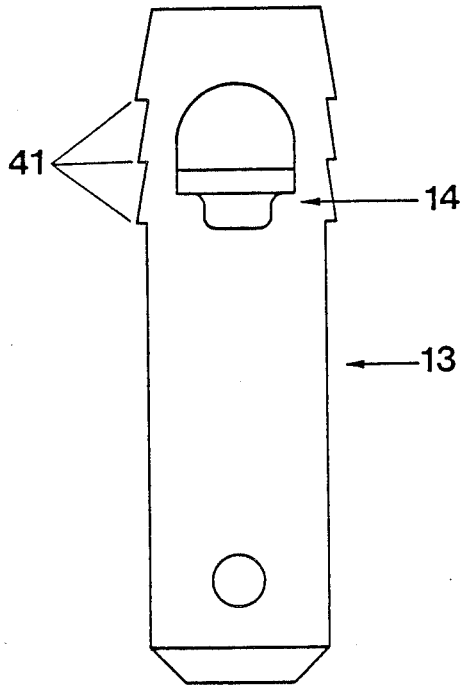

FIG. 5*a* is a cross section of the base plug of the lamp of FIG. 1;

FIG. 5*b* is a partially cut-away side view of the base plug;

FIG. 5*c* is a top view of the base plug;

FIG. 5*d* is a bottom view of the base plug;

FIG. 6*a* is a front view of a terminal spade; and

FIG. 6*b* is a longitudinal section of the spade of FIG. 6*a*.

DETAILED DESCRIPTION

Figure 2:
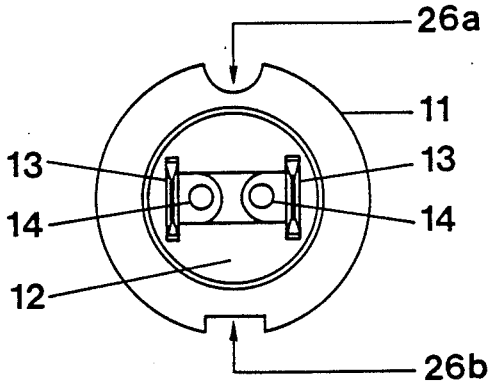
FIG. 2 is a bottom view of the lamp of FIG. 1.

FIGS. 1 and 2 illustrate an automotive-type halogen incandescent lamp of the standard designation H3. It includes a cylindrical bulb 1 of hard glass or quartz glass which, at the top, is formed with an exhaust tip 2. The end of the bulb 1 adjacent the base, also referred to as the base end, is sealed by a pinch or press seal 3 to close off the bulb 1 in vacuum-tight manner. The interior of the bulb 1 has a coiled-coil tungsten filament 4 included therein, retained by current supply leads 5, 6 of molybdenum in a position transverse to the axis of the lamp. The current supply leads 5, 6 are melt-sealed in the press seal 3, and extend outwardly of the bulb. The bulb is filled with an inert gas having a halogen additive. It is supported in the lamp base by a holder element 7 of metal, preferably high-quality steel. The holder 7 is formed of two identical holder element parts 8, the detailed construction of which will be described below in connection with FIGS. 3*a* and 3*b*. The holder element 7 is attached to the press seal 3 by providing essentially rectangular openings 18 (FIG. 3*b*), which engage in suitably formed projections on the flat sides of the press seal —not visible, and as known. The holder element 7 is received in a metallic base sleeve 9, likewise, preferably, formed of high-quality steel. The base sleeve 9, which forms a hollow cylinder and hence a holder sleeve, is formed along the circumference of a circle with four point-like inwardly projecting engagement bumps 10, to which the holder element 7 can be attached by laser welding, after the lamp has been aligned. The base sleeve 9 has an adjustment and locating ring 11 formed thereon at the side adjacent the bulb, which is formed with two differently shaped notches in order to ensure correct positioning of the lamp in a reflector. The plane of the positioning ring 11 extends transversely to the axis of the lamp.

A base plug element 12 of plastic material, for example of the material known under the trade name of ULTEM, is located at the end of the base sleeve remote from the bulb 1. The plug element is a cylindrical solid body of approximately the same diameter as the diameter of the base sleeve 9. In an H3 lamp, the base sleeve 9 has a diameter of 14 mm; the bulb of the H3 lamp has a diameter of, for example, about 12.5 mm. In an H4 lamp, which has two filaments, the base sleeve has a diameter of 20 mm, and the bulb has a diameter of about 17 mm.

Two contact spades 13 (FIGS. 1, 6*a*, 6*b*) of steel, preferably high-quality specialty steel, or of brass, bronze, or the like, extend from the base plug 12. Each one of the spades 13 is formed with an eye 14, bent off by about 90° from the plane of the spade, for electric connection with the ends of the leads 5, 6 extending from the bulb. For better protection, the essentially semi-circular eyes 14 are fitted in similarly shaped depressions 15, formed in an essentially rectangular recess 16 at the inner end of the base plug 12. This protects the eyes 14 mechanically.

The holder element 7 to couple the press 3 of the bulb 1 to the base is best seen in FIGS. 3*a* and 3*b*. The holder element 7 is of two-part construction, each part having an essentially rectangular base body 17 which engages with one wider side against the press seal 3. The two essentially rectangular openings 18 fit into projecting bumps or buttons formed on the press seal. One side of the base body 17 has three spaced tongues 20 angled off a projecting portion 19. At the opposite side of the base body 17, an extension 21 is formed on which two straps 22 are laterally so formed that they can interengage with the tongues 20 of an opposite and identical part. The two parts, which form, together, a receiving cup, then totally surround the press seal in form of a cuff. Upon assembly with a lamp 1, the tongues 20 of one part are bent over the extension 21 of the other part, and the straps 22 are bent over the projection portion 19 with the tongues 20 to form a tight, irremovable clamp connection of the holder element 7 around the pinch or press seal of the lamp —see also FIG. 1.

The base body 17, at the side facing the bulb, has an extension 23 formed thereon which, outwardly, is bent back by 180°. The projection 23 terminates in a resilient apron 24 which is outwardly bulged in conical form, and, at its end portion, defines part of a circle, which has a radius of curvature matching the inner radius of curvature of the cylindrical base sleeve 9. Preferably, the end region is essentially cylindrical, and forked into two flap elements 25. An intervening stiffening rim or offset 25' is located between the element 25 and the main part of the apron 24. The finished, assembled holder element 7, thus, with the stiffened end portions and the flaps 25, will provide essentially four part-circular legs which are welded at the engagement bumps 10 on the base sleeve 9.

The base sleeve 9 is best seen in FIGS. 4*a* and 4*b*. It has a sleeve-like body which, at the upper edge, is formed with a holding ring 11. The holding ring 11 is located at the end portion of the base sleeve close to the bulb. The ring 11 engages the opening of a reflector. It is formed with two diametrically opposite notches of different shape. One notch 26*a* is essentially circular, and the other notch 26*b* is essentially rectangular. These notches are standardized and form locating notches on the reflector.

The base sleeve 9, at the end remote from the bulb, has a radially inwardly bent flange portion 27 which is located in a plane transverse to the axis of the lamp. The flange portion 27 is very narrow; its inner diameter is only slightly smaller than the inner diameter of the base sleeve 9. The inner diameter of the base sleeve 9 is seen in FIG. 4*a* by the broken line. The flange is only about 3% smaller than this inner diameter. The flange portion 27, additionally, has four inwardly extending projections or inwardly extending flange elements 28 which radially inwardly extend the end flange as part-circumferential sections. The inward extension of the flange elements 28 is, for example, about 1 mm. The inner diameter of the theoretical circle defining the outline of the flange elements is about 80% of the outer diameter of the sleeve 9. The relationship between the length of the flange elements 28 and the intermediate free zone of the flange is about 3:1. The flange elements 28 have the same thickness as the wall of the sleeve 9; a suitable thickness is, for example, about 0.5 mm. They are used to attach the base sleeve 9 to the plug 12, forming the bottom wall of the base.

The plug element 12 is best seen in FIGS. 5*a* to 5*d*. It is an essentially solid plug 29 which, at the end facing the flange region of the sleeve 9 is formed with a collar 30, extending axially from the remainder of the plug element 29. The outer diameter of the collar 30 is reduced with respect to the diameter of the plug element 29 to about 80% and so selected that it liberally fits together with the inner diameter of the flange elements 28 of the sleeve 9. The collar 30 is subdivided into eight freely projecting sections 31, 32 (FIG. 5*c*); these projections are of different sizes, forming alternating short projections 31 and long projections 32. The four shorter collar projections or portions 31, which are about three times smaller in circumferential extent than the remaining four larger portions 32, have inclined, outwardly projecting stop noses 33 formed thereon (see FIG. 5*a*). The inclination is ramp-like. The height of the ramp is formed at the lower edge of the stop noses. The spacing of the lower edge of the stop noses 33 from the region 34, which is termed an engagement surface of the body 29, closest to the bulb 1 of the lamp and which is outside of the ring-shaped collar 30, is about 0.45 mm, and thus markedly smaller than the thickness of 0.50 mm of the flange elements 28 of the sleeve 9. In order to facilitate engagement and stopping of the flange elements 28 between the engagement surface 34 and the lower edge of the stop projecting noses 33, the lower edges are, at one side, upwardly slightly inclined. The upward inclination 35 (FIGS. 5*a*, 5*b*) extends to a level which is greater than the thickness of the flange elements 28.

A rise or projection 36 in form of a part circle is located centrally between two short portions 31, outwardly of the longer collar portions 32, and positioned on the engagement surface 34. The height of the projection or rise 36 is 0.2 mm, and its radial width or dimension is so selected that it closely matches the inner diameter of the flange portion 27 of the base sleeve 9, and thus provides for proper seating and alignment of the plug element 12 with the sleeve 9.

The length, that is, the arcuate length, of the short portions 31, and the arcuate length of the rise or projection 36, as well as the respective portions of the flange 27, are so matched and arranged with respect to each other that the sleeve 9 can, upon seating on the plug element 12, permit entry of the projections 33 —which have a length of 2.7 mm –into the portions of the flange 27. Thereafter, and upon relative rotation, the rise or projection 36 is completely fitted into the free space between the flange elements 28, so that the rise or projecting portions 36 fit against the inner edge of the inwardly bent-over flange regions 27 of the sleeve 9. The arcuate length of the inwardly directed flange region 27 must be slightly longer than the arcuate length of the shorter collar portions 31 and of the projections or rising portions 36 on the plug body 12.

The plug body 29, which is essentially solid, is formed with two axial openings or bores 37, which terminate in funnel-shaped or conical enlargements, to permit the current supply leads 5, 6 from the bulb 1 to pass therethrough. A portion of the length of the bores 37 can also be formed as a common recess 38, or terminate in a common larger recess. The bores 37, at the end remote from the bulb, terminate in a recess 15 which is essentially semicircular see FIG. 5*d*. The two recesses 15, as noted, are located in common in an essentially rectangular depression 16. They are separated from each other by a ridge 39, which ensures electrical insulation. Axial slits 40 extend into the solid body 29 at its end remote from the bulb. The width and thickness of the slits matches the width and thickness of the spade terminals 13. The depth corresponds approximately to a third of the overall length of the terminal spades 13.

The terminal spades 13 are secured in the slits 40 by sawtooth-like projections 41, see FIG. 6*a*, formed at the narrow sides of the terminal spades over about one-third of their length. These projections 41 dig into the slits and anchor themselves therein. The eyes 14, punched and bent over from the flat portions of the terminal spades 13 —see FIGS. 6*a* and 6*b* —are also in the serrated or sawtooth-deformed portions of the terminal spades. The eyes 14 are used for weld or solder connection to the leads 5, 6 from the lamp bulb.

ASSEMBLY OF THE LAMP AND THE BASE

The bulb, without the base, is first secured in a holder, and then the holder element 7 is secured to the pinch or press seal. The two holder parts are engaged about the pinch or press seal and locked together by metal deformation. The plug element 12, with the terminal spades assembled thereto, is introduced into the sleeve 9 and locked in position by relative rotation of the plug element 12 and the sleeve 9. The lamp and the base are loosely attached, and the current supply leads 5, 6 from the lamp are loosely introduced through the bores 37 of the plug body 29. The position of the lamp bulb 1 with respect to the base is then precisely adjusted by, for example, energizing the incandescent filament and adjusting the position of the bulb with respect to a fixed position of the base until the cone of light, as measured by a group of photoresponsive elements, matches a predetermined pattern. Three-dimensional changes in the position of the lamp with respect to the sleeve is possible. The degree of penetration of the holder 7 into the sleeve 9 can be changed; the holder element 7 and the sleeve 9 can be relatively rotated, and, further, the inclination of the holder element 7, in relation to the sleeve 9, can be changed. The engagement bumps 10 on the sleeve 9 and the resilient characteristics of the four aprons extending from the holder element 7 are particularly suitable to permit precise adjustment.

After the bulb 1 and the sleeve 9 are precisely adjusted, spot-welding between the apron extensions 24, for example in the region 25 thereof, and the engagement bumps 10, by laser welding, ensures permanently adjusted retention and positioning of the bulb in the sleeve 9.

Current supply leads 5, 6, extending from the bulb and projecting beyond the eyes 14 of the terminal spades 13, are cut off and a reliable permanent electrical connection is effected by soldering or welding, for example by TIG welding, that is, by tungsten-inert gas shielded welding.

The structure of the present invention is particularly suitable for automobile headlights of small dimension having only a single incandescent filament, and a two-element composite metal-plastic base. The structure may be used, however, also with different types of lamps, with and without halide fills. It is useful, also, for larger automobile headlamp light units, for example having two incandescent filaments or also for lamps having a two-part, insulating, man-made material, for example plastic material, base.

The lamp can be constructed, further, as a totally encapsulated base lamp. If desired, an inner encapsulating compound can be used, by casting a casting compound in the depression 38 (FIG. 5*a*) and/or utilizing an outer encapsulating compound, which fills the space formed by the recesses 15 and the depression 16.

Various changes and modifications may be made within the scope of the inventive concept.

We claim:

1. Cementless lamp and base combination having a single-ended glass bulb (1) having a pinch or press seal (3) at one end;

current supply leads (5, 6) extending outwardly of the bulb from the pinch or press seal;

at least one incandescent filament (4) in the bulb, electrically connected to the current supply leads;

a two-part base having a base sleeve (9) of sheet metal and a base plug element (12) of insulating material;

a holder element (7) surrounding the pinch or press seal (3) and coupled to the base sleeve (9); and terminal elements (13) secured in the base and electrically connected to the current supply leads (5, 6), wherein, the base sleeve (9) is a hollow sheet metal cylinder formed at the end remote from the bulb with at least two spaced flange elements (28) which extend inwardly of the sleeve at essentially right angles to the axis of the lamp, and the base plug element (12) is located in part within the base sleeve and in part behind the base sleeve at a position remote from the bulb and comprises an essentially cylindrical solid body (29) formed with a circumferential collar (30) having a diameter reduced with respect to the diameter of the cylindrical solid body (29), said collar (30) being subdivided into a plurality of circumferential portions (31, 32); and wherein at least two of said circumferential portions (31) are formed with radially outwardly extending holding projections (33) which engage behind and around the flange elements (28) of the base sleeve (9); and wherein the flange elements (28) comprise spaced part-circular sectional portions.

2. The combination of claim 1, wherein the arcuate extent of the holding projections (33) is slightly less than the mutual spacing of the flange elements (28).

3. The combination of claim 1, wherein the terminal elements (13) comprise flat spade elements;

and the essentially cylindrical solid body (29) is formed with longitudinal slits (40) extending axially into said solid body, the spade elements being mechanically secured in said slits (40).

4. The combination of claim 3, wherein the spade elements have side edges, said side edges being serrated or sawtooth-formed, which interengage with the surfaces of the solid body defining said slits, to retain said spade elements in position.

5. The combination of claim 3, further including bent-over eyelet flaps (14) projecting at essentially right angles from the spade elements;

wherein said solid body (29) is formed with recesses (15) at a surface thereof remote from the bulb (1), said eyes fitting into said recesses;

and wherein the current supply leads (5, 6) are electrically secured in said eyes.

6. The combination of claim 5, wherein said cylindrical solid body is formed with a depression (16), said recesses (15) being located and recessed in said depression.

7. The combination of claim 1, wherein the external diameter of the base sleeve (9) and the external diameter of the base plug element outwardly of said collar are of approximately equal dimension;

and wherein the outer diameter of said collar (30) is approximately 80% of the outer diameter of the remainder of the solid body (29).

8. The combination of claim 1, wherein the base sleeve (9) is formed with a positioning ring (11) at the side thereof adjacent the bulb (1), said positioning ring extending at a right angle with respect to an axis formed by said base sleeve.

9. The combination of claim 1, wherein holder elements (7) is metallic, and the base sleeve (9) has a plurality of essentially point or bump-like inwardly extending projections (10), the holder element (7) being welded to said projections.

10. Cementless lamp and base combination having a single-ended glass bulb (1) having a pinch or press seal (3) at one end;

current supply leads (5, 6) extending outwardly of the bulb from the pinch or press seal;

at least one incandescent filament (4) in the bulb, electrically connected to the current supply leads;

a two-part base having a base sleeve (9) of sheet metal and a base plug element (12) of insulating material;

a holder element (7) surrounding the pinch or press seal (3) and coupled to the base sleeve (9); and terminal elements (13) secured in the base and electrically connected to the current supply leads (5, 6), wherein, the base sleeve (9) is a hollow sheet metal cylinder formed at the end remote from the bulb with at least two spaced flange elements (28) which extend inwardly of the sleeve at essentially right angles to the axis of the lamp, and the base plug element (12) is located in part within the base sleeve and in part behind the base sleeve at a position remote from the bulb and comprises an essentially cylindrical solid body (29) formed with a circumferential collar (30) having a diameter reduced with respect to the diameter of the cylindrical solid body (29), said collar (30) being subdivided into a plurality of circumferential portions (31, 32); and wherein at least two of said circumferential portions (31) are formed with radially outwardly extending holding projections (33) which engage behind and around the flange elements (28) of the base sleeve (9);

a circumferential groove spacing said holding projections (33) of said collar from the remainder of the solid body (29) of the plug element (12);

and wherein the spacing between the end surface (34) of said solid body and the holding projections (33) of the collar is smaller than the thickness of the flange elements (28) of the base sleeve (9).

11. The combination of claim 10, wherein said spacing is smaller by about 10% than the thickness of the flange elements.

12. The combination of claim 10, wherein said holding projections (33) are formed with laterally inclined surfaces (35).

13. Cementless lamp and base combination having a single-ended glass bulb (1) having a pinch or press seal (3) at one end;

current supply leads (5, 6) extending outwardly of the bulb from the pinch or press seal;

at least one incandescent filament (4) in the bulb, electrically connected to the current supply leads;

a two-part base having a base sleeve (9) of sheet metal and a base plug element (12) of insulating material;

a holder element (7) surrounding the pinch or press seal (3) and coupled to the base sleeve (9); and terminal elements (13) secured in the base and electrically connected to the current supply leads (5, 6), wherein, the base sleeve (9) is a hollow sheet metal cylinder formed at the end remote from the bulb with at least two spaced flange elements (28) which extend inwardly of the sleeve at essentially right angles to the axis of the lamp, and the base plug element (12) is located in part within the base sleeve and in part behind the base sleeve at a position remote from the bulb and comprises an essentially cylindrical solid body (29) formed with a circumferential collar (30) having a diameter reduced with respect to the diameter of the cylindrical solid body (29), said collar (30) being subdivided into a plurality of circumferential portions (31, 32); and wherein at least two of said circumferential portions (31) are formed with radially outwardly extending holding projections (33) which engage behind and around the flange elements (28) of the base sleeve (9);

wherein said solid body (29) is formed with an engagement surface (34) to fit against a flange portion (27) of the base sleeve (9) located in the plane of the flange elements (28);

and wherein locating rises or projections (36) extend from said engagement surface, located approximately centrally of the holding projections (33) for locating said flange portion (27) on the solid body (29).

14. The combination of claim 13, wherein holder elements (7) is metallic, and the base sleeve (9) has a plurality of essentially point or bump-like inwardly extending projections (10), the holder element (7) being welded to said projections.

15. The combination of claim 13, wherein the height of the rises or projections (36) extends up to half the distance between the engagement surface and the holding projections (33).

16. The combination of claim 13, wherein the rises or projections (36) have part-circular ring shape, externally fitting against at least some of the circumferential portions (32) of the collar, and having an arcuate extent less than the spacing of the flange elements (28) of the base sleeve.

17. The combination of claim 13, wherein the radial width of the rises or projections (36) is less than the radial width of the flange elements (28) of the base sleeve (9);

the flange portion (27) of the base sleeve (9) being bent over radially inwardly and forming, with respect to said flange elements, recessed regions, the radial width of the recessed regions (27) being dimensioned to fit against the circumferential surfaces of the rises or projections (36).

18. Cementless lamp and base combination having a single-ended glass bulb (1) having a pinch or press seal (3) at one end;

current supply leads (5, 6) extending outwardly of the bulb from the pinch or press seal;

at least one incandescent filament (4) in the bulb, electrically connected to the current supply leads;

a two-part base having a base sleeve (9) and a base plug element (12) of insulating material;

a holder element (7) surrounding the pinch or press seal (3) and coupled to the base sleeve (9); and terminal elements (13) secured in the base and electrically connected to the current supply leads (5, 6), wherein, the base sleeve (9) is a hollow cylinder formed at the end remote from the bulb with at least two spaced flange elements (28) which extend inwardly of the sleeve at essentially right angles to the axis of the lamp, and the base plug element (12) is located at least in part within the base sleeve at a position remote from the bulb and comprises an essentially cylindrical solid body (29) formed with a circumferential collar (30) having a diameter reduced with respect to the diameter of the cylindrical solid body (29), said collar (30) being subdivided into a plurality of circumferential portions (31, 32); wherein at least two of said circumferential portions (31) are formed with radially outwardly extending holding projections (33) which engage behind and around the flange elements (28) of the base sleeve (9); and wherein the terminal elements (13) comprise flat spade elements;

and the essentially cylindrical solid body (29) is formed with longitudinal slits (40) extending axially into said solid body, the spade elements being mechanically secured in said slits (40).

19. The combination of claim 18, wherein the spade elements have side edges, said side edges being serrated or sawtooth-formed, which interengage with the surface of the solid body defining said slits, to retain said spade elements in position.

20. The combination of claim 18, further including bent-over eyelet flaps (14) projecting at essentially right angles from the spade elements;

wherein said solid body (29) is formed with recesses (15) at a surface thereof remote from the bulb (1), said eyes fitting into said recesses;

and wherein the current supply leads (5, 6) are electrically secured in said eyes.

21. The combination of claim 18, wherein said cylindrical solid body is formed with a depression (16), said recesses (15) being located and recessed in said depression.

* * * * *